US009890644B2

(12) United States Patent
Tran et al.

(10) Patent No.: US 9,890,644 B2
(45) Date of Patent: Feb. 13, 2018

(54) FOUNDRY CORE ASSEMBLY FOR MANUFACTURING A TURBOMACHINE BLADE, ASSOCIATED METHOD OF MANUFACTURING A BLADE AND ASSOCIATED BLADE

(71) Applicant: SNECMA, Paris (FR)

(72) Inventors: Huu-Thanh Tran, Moissy-Cramayel (FR); Michael Hansom, Moissy-Cramayel (FR); Christian Bariaud, Moissy-Cramayel (FR); Patrice Eneau, Moissy-Cramayel (FR)

(73) Assignee: SNECMA, Paris (FR)

( * ) Notice: Subject to any disclaimer, the term of this patent is extended or adjusted under 35 U.S.C. 154(b) by 601 days.

(21) Appl. No.: 14/380,459

(22) PCT Filed: Feb. 12, 2013

(86) PCT No.: PCT/EP2013/052785
§ 371 (c)(1),
(2) Date: Aug. 22, 2014

(87) PCT Pub. No.: WO2013/124189
PCT Pub. Date: Aug. 29, 2013

(65) Prior Publication Data

US 2015/0132139 A1 May 14, 2015

(30) Foreign Application Priority Data

Feb. 22, 2012 (FR) ..... 12 51620

(51) Int. Cl.
*F01D 5/14* (2006.01)
*B22C 7/02* (2006.01)
(Continued)

(52) U.S. Cl.
CPC ..... *F01D 5/147* (2013.01); *B22C 7/02* (2013.01); *B22C 9/04* (2013.01); *B22C 9/103* (2013.01);
(Continued)

(58) Field of Classification Search
CPC ..... F01D 5/187; F01D 5/147; B22C 9/103; B22C 9/04; B22C 21/14
See application file for complete search history.

(56) References Cited

U.S. PATENT DOCUMENTS 5,296,308 A 3/1994 Caccavale et al.
8,105,031 B2 * 1/2012 Trindade ..... F01D 5/186 416/97 R
(Continued)

FOREIGN PATENT DOCUMENTS

EP 0 585 183 3/1994
FR 2 957 828 9/2011

OTHER PUBLICATIONS

International Search Report dated Jun. 25, 2013 in PCT/EP13/052785 Filed Feb. 12, 2013.
(Continued)

*Primary Examiner* — Atif Chaudry
(74) *Attorney, Agent, or Firm* — Oblon, McClelland, Maier & Neustadt, L.L.P.

(57) ABSTRACT

A foundry core for manufacturing a blade of a turbomachine including a tip section offset, including a core element for forming various internal cavities, the core element including a leading-edge cavity internal core, central cavity internal cores, and a trailing-edge cavity internal core. The internal core for the central cavity adjacent to the internal core for the trailing-edge cavity includes a bulge extending toward the core for the leading-edge cavity.

7 Claims, 5 Drawing Sheets

(51) Int. Cl.

| | |
|---|---|
| ***B22C 21/14*** | (2006.01) |
| ***F01D 5/18*** | (2006.01) |
| ***B22C 9/04*** | (2006.01) |
| ***B22C 9/10*** | (2006.01) |

(52) U.S. Cl.
CPC ..... *B22C 21/14* (2013.01); *F01D 5/187* (2013.01); *F05D 2230/211* (2013.01)

(56) References Cited

U.S. PATENT DOCUMENTS

2004/0076519 A1* 4/2004 Halfmann ..... B22C 9/04
416/97 R
2009/0285684 A1* 11/2009 Pinero ..... F01D 5/187
416/92

OTHER PUBLICATIONS

International Search Report dated Jun. 25, 2013 in PCT/EP2013/052785 (with English translation of category of cited documents).
Preliminary Search Report dated Nov. 9, 2012 in French Patent Application No. FR 1251620 (with English translation of category of cited documents).

* cited by examiner

FOUNDRY CORE ASSEMBLY FOR MANUFACTURING A TURBOMACHINE BLADE, ASSOCIATED METHOD OF MANUFACTURING A BLADE AND ASSOCIATED BLADE

BACKGROUND OF THE INVENTION

Field of The Invention

The invention relates generally to the field of turbomachines, and more particularly that of turbine blades of these turbomachines and to their manufacture.

Description of the Related Art

Turbine blades are subjected to strong thermal stresses due to the heat in gases in which they are plunged at the outlet of the combustion chamber, and need to be cooled to support these temperatures. They are accordingly hollow and traversed by internal cavities in which cooling gas circulates, taken at the outlet of a stage of one of the compressors.

More precisely, a turbine blade of a turbomachine comprises an aerodynamic surface (or blade) extending between a blade foot and a blade tip. The blade has a leading edge arranged opposite the flow of hot gases coming from the combustion chamber of the turbomachine, as well as a trailing edge opposite the leading edge and the lateral intrados and extrados walls which connect the leading edge to the trailing edge.

The internal cavities extend over the height of the blade, and comprise, from upstream to downstream in the direction of the flow of gases from the combustion chamber, a leading edge cavity and a trailing edge cavity, adjacent to the leading edge and the trailing edge of the blade respectively, and at least one central cavity, extending between the leading edge cavity and the trailing edge cavity. These cavities are fed with cooling gas via tubing connecting them to the foot of the blade.

The blade also comprises, at the level of its tip, a hollow form or bath, which is defined by the extension of the intrados and extrados walls, as well as by a bottom wall which close off the internal cavities.

To make these different cavities, which have complex forms and whereof the geometry must be respected with great precision, the blades are classically produced by a technique known under the name of lost wax smelting. This technique consists schematically of making a blade draft of wax in which cores made of ceramic which reproduce the resulting cavities are embedded. The wax blade is then embedded in a carapace, for example made of refractory material, then the cores are eliminated chemically, leaving in their place the preferred internal cavities and bath. Embodiments of this method are described in particular in documents FR 2 875 425, FR 2 874 186, or FR 2 957 828 in the name of the applicant.

The cores for these modern turbine blades are constituted by internal cavity cores, having classically the form of columns, which are positioned side by side and held together by conventional means.

These cores have increasingly more complex forms, as the specifications required for cooling of blades grow and the blades diversify. It is necessary to position them in the carapace with extreme precision.

A core generally comprises a first core element designed to form the cavities and a second core element designed to form the bath, the second core element being connected to the first core element by linking rods made of alumina or quartz.

The aim of these rods is to hold between them the parts of the core and stiffen the resulting assembly, and they are involved in making dedusting holes in the upper part of the blade. These rods are stored in the holes which they tend to make in the bottom of the bath. The dedusting holes enable circulation of the cooling gas in the cavities and evacuation of various particles entering the turbomachine.

To improve the aerodynamic performance of the blade and minimise energy losses, it has been proposed to use turbine blades for turbomachines having an advanced blade tip of the type "offset of tip sections" according to the French patent application registered on Nov, 17 2011 No. FR 11 60465 in the name of the applicant.

Such turbine blades are adapted to minimise energy losses. They comprise a blade which can be broken down into blade sections stacked according to a stacking direction along the blade. In the case of the blade tip with tip section offset, the stacking of the sections at the level of the tip of the blade is offset in the direction of the intrados wall, preferably progressively.

For this, as described in patent application No. FR 11 60465, the blade can comprise a cavity at the level of its tip, open in the direction of its free end and delimited by the bottom wall and a rim which extends between the leading edge and the trailing edge. The stacking of the blade sections of the blade at the level of this rim presents offset in the direction of the intrados, this offset increasing as the free end of the tip of the blade is approached. The blade also comprises cooling channels, inclined relative to the intrados, and connecting the internal cavities to the intrados wall.

The intrados wall of the blade can also present a projecting portion, whereof the outer face is inclined relative to the rest of the intrados of the blade and has at its end a terminal face, turned towards the rim. The bottom wall is connected to the intrados wall at the level of the terminal face of the projecting portion, and the cooling channels can be arranged in the projecting portion of the intrados wall such that they terminate on the terminal face of the projecting portion, the distance between the axis of the cooling channels and the outer limit of the free end of the rim of the intrados side being greater than zero.

However, this tip section offset and the small size of the blade, and therefore of the cores used for its manufacture, make it difficult to hold the rods of the second core element which is designed to former the bath on the first core element.

It has therefore been proposed to orient the rods individually, with big angles relative to the main direction of the blade. However, the cores are complex to produce due to the strong inclination of the linking rods relative to the main direction of the cores (and therefore of the injection of ceramic), which can raise problems of wear of the cores at the level of the bottom of the bath. Also, executing this manufacturing method needs knowhow and experience which are accessible to all those skilled in the art, specifically the founders, as here.

It has also been proposed to use linking rods anchored conventionally in the core elements, but with anchoring strongly reduced in comparison with conventional techniques, due to the minimal dimension of the internal cavities of the blade. But, the anchoring depth and the thickness of the cores (generally made of ceramic) about the linking rods cause problems of cracking (partial ruptures which occur under the action of forces resulting from uneven withdrawal) in the core elements, and therefore an excessive rate of discard.

BRIEF SUMMARY OF THE INVENTION

The invention proposes as such an assembly forming a core for the manufacture of a turbomachine blade cooled by circulation of fluid in internal cavities, comprising a first core element of elongated form for the formation of different internal cavities and a second core element for the formation of a bath cavity, the second core element being designed to be arranged in the extension of the first core element. The first core element comprises an internal core of a leading edge cavity, at least one central cavity internal core and a trailing edge cavity internal core designed to form respectively, from upstream to downstream in the direction of flow of gases in the turbine, a leading edge cavity, at least one central cavity and a trailing edge cavity of the blade. The core of the central internal cavity adjacent to the internal core of the trailing edge cavity has, in the immediate vicinity of the second core element, a bulge which extends in the direction of the core of the leading edge cavity.

Such a solution enables anchoring of at least one linking rod at the level of an enlarged area of the first core element (at the level of the bulge), and consequently producing turbine blades for turbomachines having an offset of tip sections according to a reliable method with a minimal rate of discard of cores.

The invention also relates to a blade produced by means of such an assembly forming a foundry core, as well as a manufacturing method using such an assembly.

BRIEF DESCRIPTION OF THE SEVERAL VIEWS OF THE DRAWINGS

Other characteristics, aims and advantages of the present invention will emerge more clearly from the detailed following description, given in reference to the attached drawings given by way of non-limitation and in which.

DETAILED DESCRIPTION OF THE INVENTION

Figure 1:
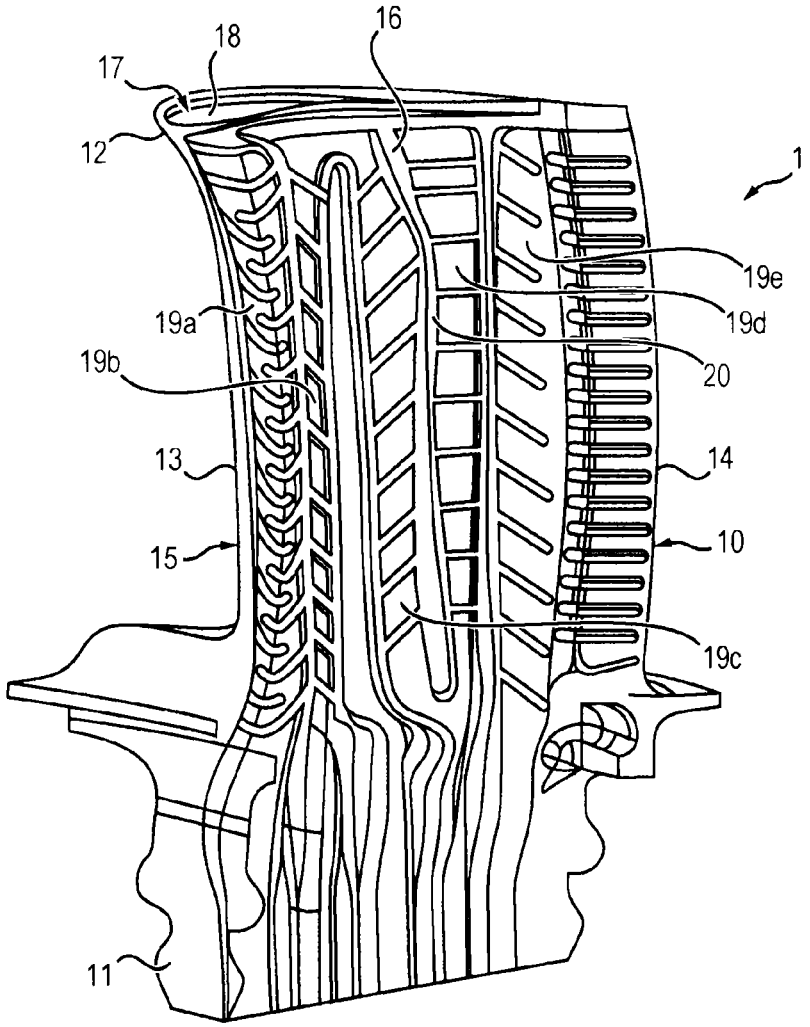
FIG. 1 is a general view in section and in semi-perspective of an example of a turbine blade with tip section offset according to the invention.
Figure 5A:
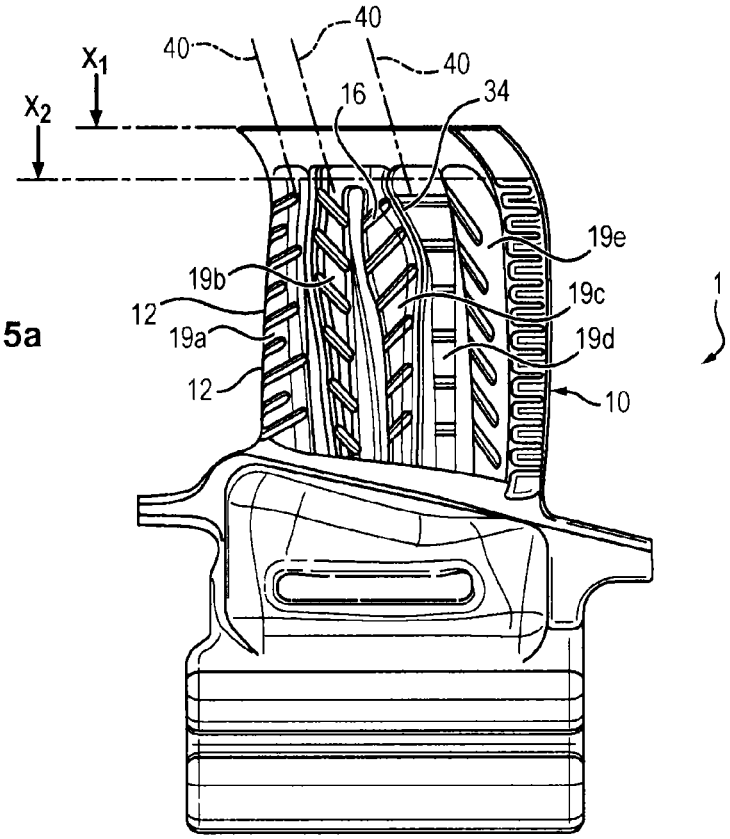
FIG. 5*a* is a side elevation of an example of a blade with tip section offset in keeping with the invention.
Figure 5B:
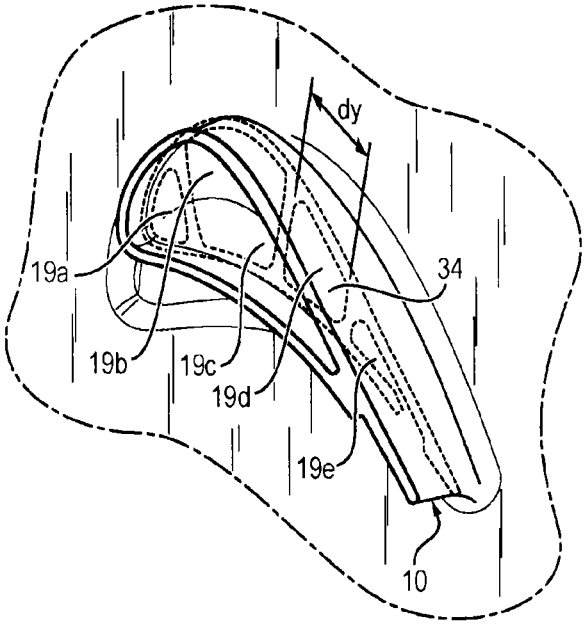
FIG. 5*b* is a view of the top of the blade of FIG. 5*a*, showing the cavities according to the planes Y1 and Y2.

In reference to FIGS. 1 and 5*a*, these show a turbine blade 1 for a turbomachine comprising a blade 10 extending between a blade foot 11 and a blade tip 12, and comprising a leading edge 13, a trailing edge 14 opposite the leading edge, lateral intrados and extrados faces 15, and internal cavities 19*a*-19*e* separated by intercavity walls 20 which extend according to the height of the blade 1.

The blade can for example present an advanced blade apex of the type "tip section offset" in keeping with French patent application No. FR 11 60465 registered on Nov. 17, 2011 in the name of the applicant.

Especially, from the leading edge 13 to the trailing edge 14, the blade 1 comprises a leading edge cavity 19*a*, one or more central cavities 19*b*, 19*c*, 19*d*, (in this case three for the blade 1 shown in the figure, specifically a first rising central cavity 19*b*, a descending central cavity 19*c*, and a second rising central cavity 19*d*, which together form assembly an internal cavity "trombone", and a trailing edge cavity 19*e*. The blade 1 also comprises, at the level of its tip 11, a bath 18, whereof the bottom wall 17 closes off the internal cooling cavities 19*a*-19*e*.

The intercavity wall 20 separating the central cavity 19*d* adjacent to trailing edge the cavity 19*e* and the following cavity in the direction of the leading edge 13 (that is, in the case of the blade of FIG. 1, the central cavity 19*c*) complies, in the vicinity of the bottom wall 17 of the bath 18, with an offset 16 in the direction of the leading edge 13.

As a variant, when the blade 1 comprises only a single central cavity 19*d*, it is the intercavity wall 20 which separates this single central cavity 19*d* from the leading edge cavity 19*a* which can match, in the vicinity of the bottom wall 17 of the bath, with an offset 16 in the direction of the leading edge 13.

Due to this offset 16 relative to the rest of the intercavity wall 20, the central cavity 19*d* which is adjacent to the trailing edge cavity 19*e* has a bulge 34 in the vicinity of the bottom wall 17, said cavity 19*d* being wider at the level of the blade tip 12 than at the level of the blade foot 11. The particular form of this central cavity 19*d* simplifies the manufacturing of the blade 1.

Also, as illustrated in FIGS. 1 and 5*a*, the intercavity wall 20 is offset at the level of the offset 16 as far as the bottom wall 17 to enlarge the entire upper part of this central cavity 19*d*.

The assembly forming a foundry core 30 for the manufacture of such a turbomachine blade (FIGS. 2 and 3) has an adapted complementary form and comprises a first core element 31, repeating the form of the cavities 19*a*-19*e*, and a second core element 32, repeating per se the form of the bath 18. The two core elements 31 and 32 are for example made of ceramic.

The second core element 32 is connected to the first core element 31 by linking rods 40 which can for example be made of aluminium or quartz.

The first core element 31 has an overall elongated form according to the height of the blade 1 and comprises a series of internal cores (or columns) 31*a*, 31*b*, 31*c*, 31*d* and 31*e*, designed to form respectively the cavities of a leading edge 19*a*, the central cavity/cavities 19*b*, 19*c* and 19*d*, and the trailing edge cavity 19*e* respectively.

The second core element 32 is arranged above the first core element 31, and is separated from the latter by linking rods 40 positioned so as to form dedusting holes 35 in the internal cores 31*a* to 31*e*.

The internal core 31*d* defining the central cavity 19*d* adjacent to the core 31*e* of the trailing edge cavity has, at least in an area immediately near the second core element 32, a bulge 34 in the direction of the internal core 31*a* of the leading edge cavity. The internal core 31*c* of the corresponding central cavity is therefore wider at this level, for example from 30% to 60% wider, as is evident in FIGS. 4*a* to 5*b*. In fact, on a conventional blade with tip section offset, the maximal width $d_x$ of the core of the internal cavity 31*d* adjacent to the core of the trailing edge cavity 31*e* at the level of the plane is of the order of 3.4 mm. In comparison, the maximal width $d_y$ of the core of the internal cavity 31*d* which is adjacent to the trailing edge cavity internal core 31*e* at the level of the plane $Y_2$, for a similar blade with tip section offset but comprising a bulge 34 according to the invention, can be of the order of 5 mm (or around 50% wider). The space available for implanting a linking rod 40 in this cavity core 31*d* is therefore much greater than in the blades of the prior art, which increases the anchoring depth and the thickness of the cores about the linking rods 40 and prevents the formation of cracking in the core elements 31, 32, and therefore significantly reduces the rate of discard of blades during manufacture.

Also, the central cavity internal core 31*c* immediately adjacent in the direction of the cavity 31*a* of a leading edge as such matches a complementary counterform 33 such that the intercavity wall 20 made between these two internal cores 31*c* and 31*d* has the offset 16 described hereinabove in the direction of the leading edge 13 of the blade 1.

As a variant, when the blade 1 comprises only a single central cavity 19*d*, the first core 31 comprises only a single central cavity internal core 31*c*, and it is the internal core 31*a* of the leading edge cavity which is immediately adjacent to this central core internal core 31*d*. It is therefore the internal core 31*a* of a leading edge which matches the complementary counterform such that the intercavity wall 20 made between these two internal cores 31*a* and 31*d* has the offset 16 described hereinabove in the direction of the leading edge 13 of the blade 1.

The bulge 34 and the counterform 33 are local, and extend only at the level of the upper part of the internal cores 31*b*-31*d* (respectively 31*a*, in the case of a blade comprising a single central cavity), the core 31*d* adjacent to the core 31*e* of the trailing edge cavity being wider at the level of this bulge 34 than at the level of its lower part.

The height of the bulge 34 is sufficient to allow anchoring of the linking rods 40 at the level of the bulge 34, and making dedusting holes 35 in the wall 17 forming the bottom of the bath 18 without formation of cracks in the internal cores 31*b*-31*d*. Also, the bulge 34 extends as far as the upper wall of the central cavity internal core 31*e*.

Making these dedusting holes 35 is made easier by modification of the geometry of the internal core 31*d* adjacent to the trailing edge core 31*e* and more particularly by the existence of the bulge 34 in its upper part. In particular, because of the aerodynamic form of the blade 10, which has an increasing transversal cross-section between the trailing edge 14 and the leading edge 13, the presence of the bulge 34 anchors the linking rods 40 in an area of the core 31 wider than with a configuration of a classic core, and consequently limits the angle formed between the linking rods 40 and the main axis of the cores. Making the holes 35 is therefore more favourable for foundry and also improves the possibilities for anchoring the linking rods 40.

Also, the diameter of the retaining rods 40 can be selected so as to be equal to the preferred diameter for the dedusting holes 35 in the final item to avoid an extra step for finishing the blade 10 (capping of holes) after the step of lost wax smelting.

Figure 2:
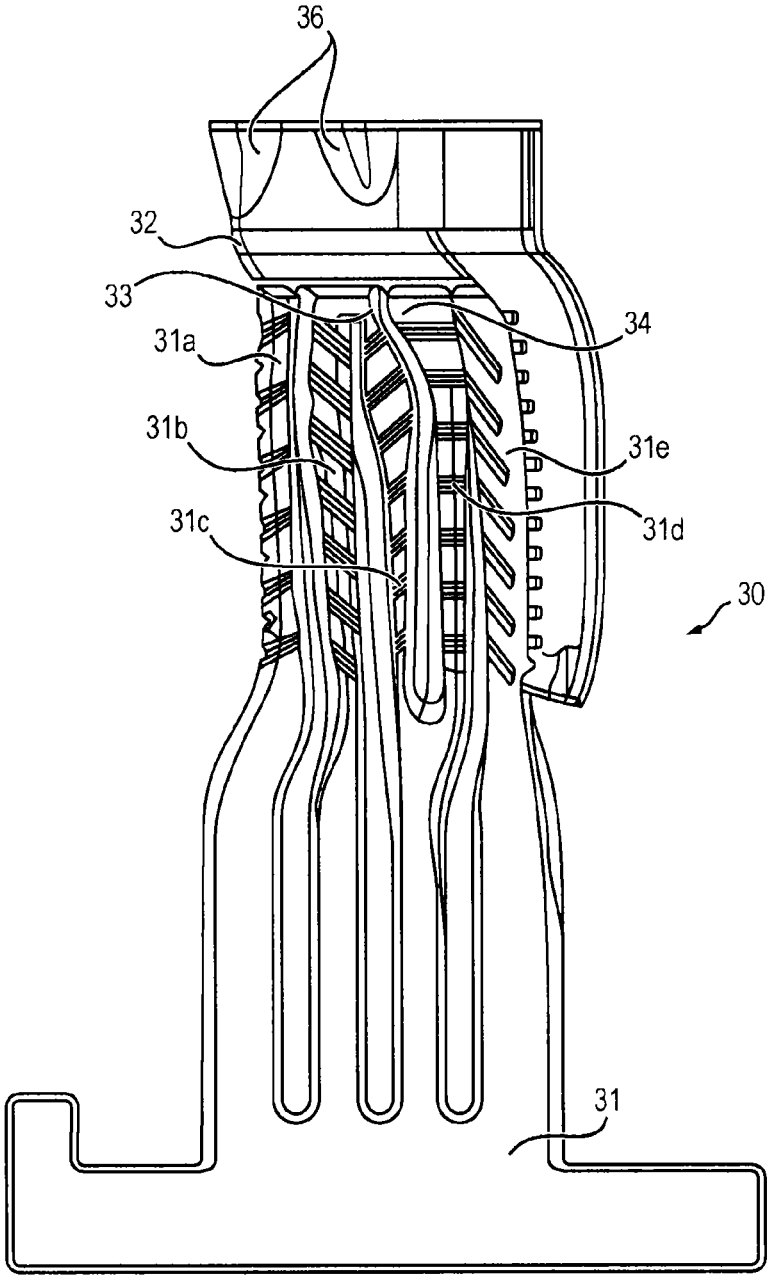
FIG. 2 is a representation in perspective illustrating a foundry core according to an embodiment of the invention.
Figure 3:
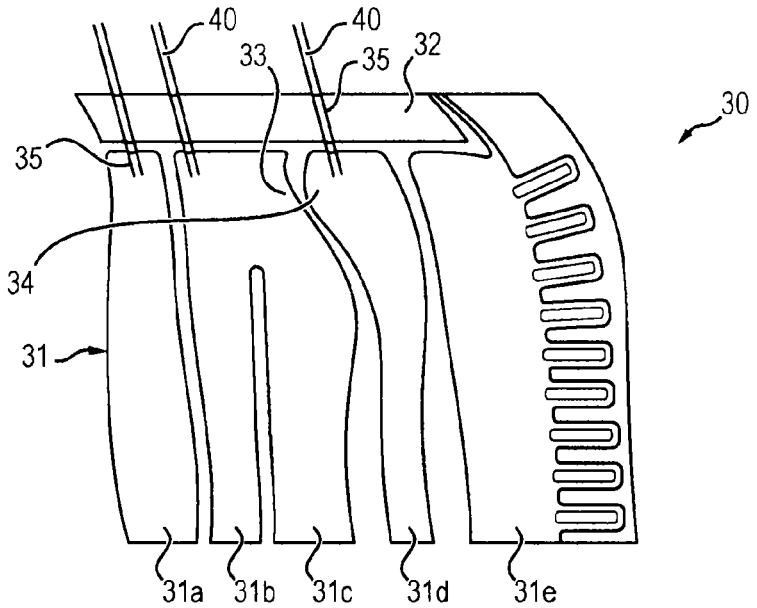
FIG. 3 is a representation of a detail of the upper part of the foundry core of FIG. 2 and the linking rods between the different core elements.
Figure 4A:
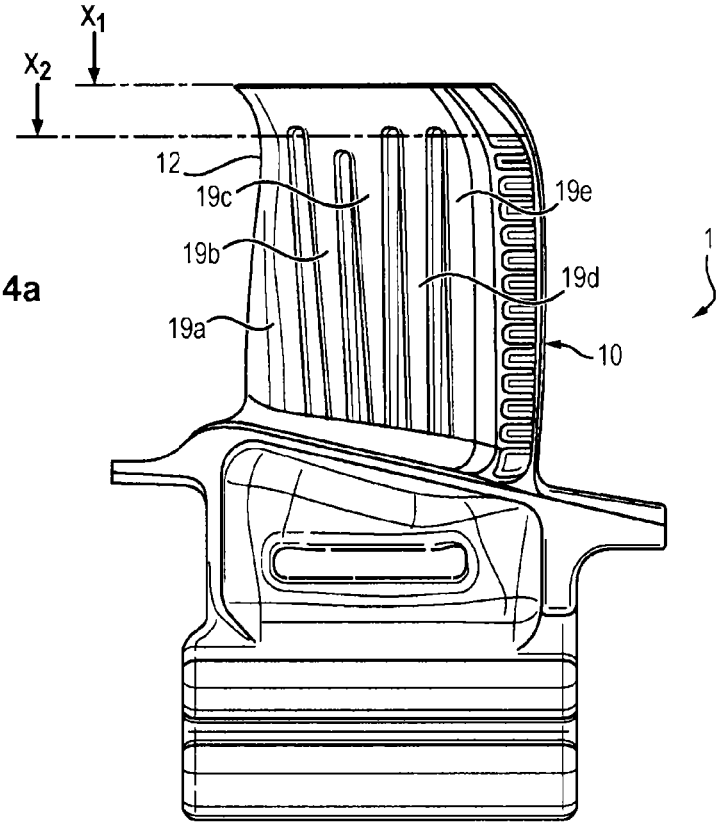
FIG. 4*a* is a side elevation of an example of a blade with tip section offset in keeping with the prior art.
Figure 4B:
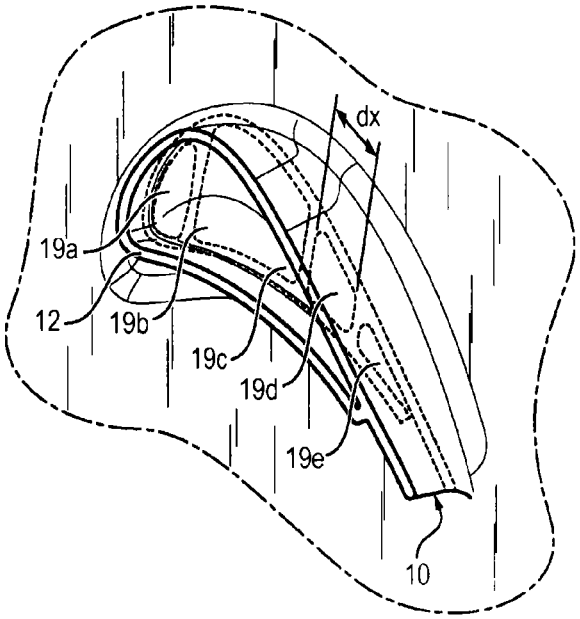
FIG. 4*b* is a view of the top of the blade of FIG. 4*a*, showing the cavities according to the planes X1 and X2.

As illustrated in FIGS. 2 and 3, the dedusting holes 35 are oblique and can for example be oriented towards the leading edge 13 of the blade 1. This orientation is however not limiting, with respecting of the diameter of the retaining rods 40 being considerable to ensure evacuation of dust in the blade 1.

The linking rods 40 are accordingly oriented obliquely relative to the general direction according to which the second core element 32 they pass through extends to form the dedusting holes 35 of the second core element 32.

The second core element 32 can also comprise bosses 36 (FIG. 2) in the upper part to improve the anchoring of the linking rods 40.

The assembly forming a foundry core 30 such as illustrated in FIGS. 2 and 3 is then used to make a wax draft, which is then embedded in a carapace, then the cores are eliminated to form the different cavities 19*a*-19*e* and the bath 18.

The invention claimed is:

1. An assembly forming a foundry core for manufacturing a blade of a turbomachine including a tip section offset cooled by circulation of fluid in internal cavities, comprising:

a first core element of elongated form for formation of different internal cavities; and a second core element for formation of a bath cavity, the second core element being configured to be arranged in an extension of the first core element, wherein the first core element comprises a leading edge cavity internal core, at least one central cavity internal core, and a trailing edge cavity internal core configured to respectively form, from upstream to downstream in a direction of flow of gas in the turbine, a leading edge cavity, at least one central cavity, and a trailing edge cavity of the blade, and wherein the at least one central cavity internal core adjacent to the trailing edge cavity internal core includes a bulge that extends in a direction of the leading edge cavity internal core only in an immediate vicinity of the second core element.

2. The assembly forming a foundry core according to claim 1, wherein an internal core, which is opposite the central cavity internal core that includes the bulge, includes a counterform that is complementary to the bulge.

3. The assembly forming a foundry core according to claim 1, further comprising at least one linking rod that extends between the second core element and the bulge by being anchored in each other.

4. The assembly forming a core according to claim 3, wherein the at least one linking rod anchored in the bulge extends obliquely relative to the second core element.

5. The assembly forming a core according to claim 3, wherein the at least one linking rod is made of oxidized aluminum or quartz.

6. The assembly forming a core according to claim 1, wherein the first core element comprises four internal cores.

7. The assembly forming a foundry core according to claim 1, wherein a maximum width of the at least one central cavity formed by the at least one central cavity internal core is 5 mm.

* * * * *